US005970593A

United States Patent [19]

Sear

[11] Patent Number: 5,970,593

[45] Date of Patent: Oct. 26, 1999

[54] JET FOR INTERLACING TEXTILE YARNS

[75] Inventor: Nicolas C Sear, Winston-Salem, N.C.

[73] Assignee: International Machinery Sales, Inc., Winston-Salem, N.C.

[21] Appl. No.: 09/273,415

[22] Filed: Mar. 19, 1999

Related U.S. Application Data

[63] Continuation-in-part of application No. 08/928,887, Sep. 12, 1997.

[51] Int. Cl.[6] ..... D02J 1/08

[52] U.S. Cl. ..... 28/272; 28/274

[58] Field of Search ..... 28/271, 272, 273, 28/274, 275, 276; 57/333, 350

[56] References Cited

U.S. PATENT DOCUMENTS

| | | | |
|---|---|---|---|
| 3,665,566 | 5/1972 | Ohayon | 28/275 |
| 3,750,242 | 8/1973 | Lloyd et al. . | |
| 4,397,140 | 8/1983 | Sheehan et al. | 28/274 |
| 4,430,780 | 2/1984 | Sear et al. . | |
| 4,631,791 | 12/1986 | Symon | 28/274 |
| 4,644,622 | 2/1987 | Bauer et al. . | |
| 4,953,271 | 9/1990 | Wellenhofer et al. | 28/272 |
| 5,010,631 | 4/1991 | Ritter . | |
| 5,079,813 | 1/1992 | Agers et al. | 28/274 |
| 5,140,729 | 8/1992 | Simmen | 28/274 |
| 5,146,660 | 9/1992 | Ritter . | |
| 5,157,819 | 10/1992 | Hodan . | |
| 5,275,618 | 1/1994 | Koyfman et al. . | |
| 5,475,908 | 12/1995 | Scherpf et al. . | |
| 5,675,878 | 10/1997 | Brown et al. . | |

OTHER PUBLICATIONS

Hebverlein—Key Components for your Success (Sep. 95).

*Primary Examiner*—Amy B. Vanatta
*Attorney, Agent, or Firm*—Robert W. Pitts

[57] ABSTRACT

Either multiple open slot air jets 2 or multiple closed jets 102 interlacing yarn can be positioned side by side in abutting relationship so that the jets can be positioned in close proximity to decrease the centerline spacing for adjacent yarns. An open slot air interlacing jet 2 includes a yarn channel 20 and a threading slot 42 forming an opening on one side of the yarn channel so that yarn or yarn filaments can be inserted into the yarn channel. An air orifice 40 intersects the yarn channel and high pressure air injected through the air inlet or orifice 40 interlaces or intertwines the yarn or yarn filaments as they are drawn through the yarn channel 20. Thread guides 58, 60 located below the yarn channel axis and the tapered yarn channel sections permit the yarn to be drawn through the yarn channel 20 at an angle relative to the threading slot 42 so that the yarn cannot easily escape from the yarn channel 20. Open jets 2 and closed jets 102 have grooves 52 and 152 respectively located on both sides of the jet bodies adjacent to the bottom surface which receive rods 56, 156 for mounting the jets.

12 Claims, 6 Drawing Sheets

Fig. 7
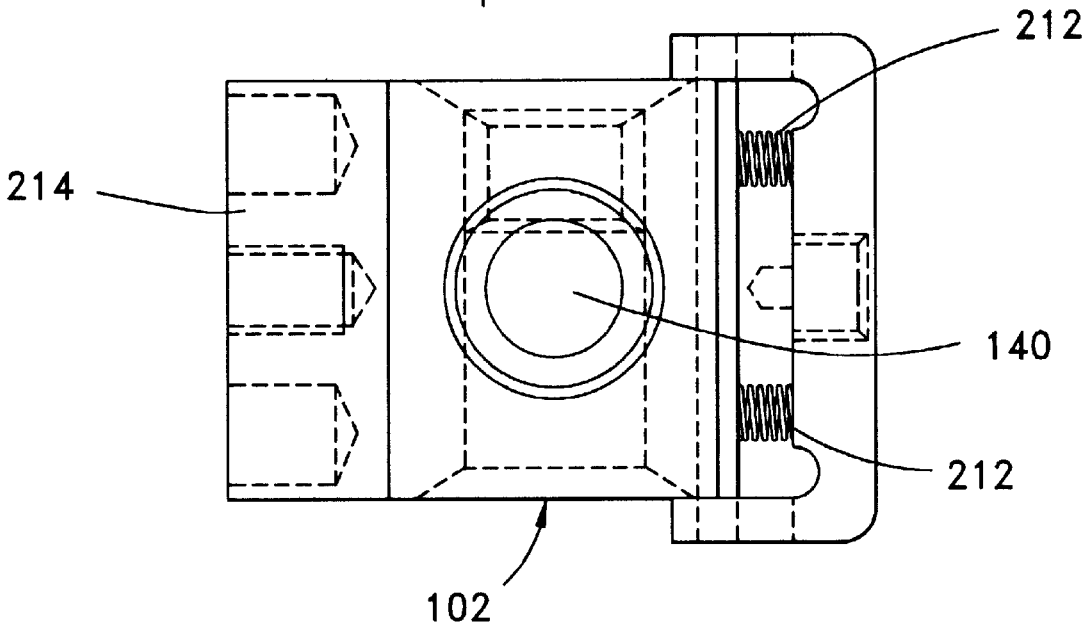
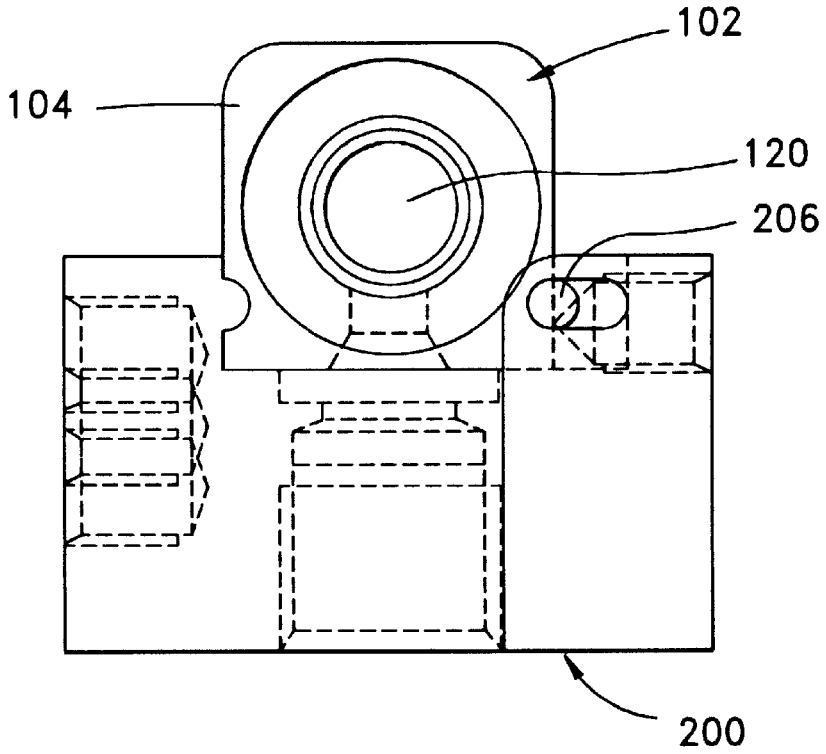
Fig. 8

JET FOR INTERLACING TEXTILE YARNS

CROSS REFERENCE TO PRIOR CO-PENDING APPLICATIONS

This application is a continuation in part of prior co-pending application Ser. No. 08/928,887 filed Sept. 12, 1997.

BACKGROUND OF THE INVENTION

1. Field of the Invention

This invention is related to the air intermingling, interlacing, commingling, or bulking of yarns or yarn filaments with an air jet. More specifically this invention is related to an interlacing jet in which the yarn or yarn filaments are subjected to a turbulent air stream as the yarn or yarn filaments pass through a channel into which high pressure air is injected.

2. Description of the Prior Art

A number of air jet configurations are used to interlace or bulk multifilament yarns. Both closed jet and open jet configurations have been used in prior art applications. The following patents show some of the air jets or air jet inserts that have been used in applications where air is injected into a yarn channel transverse to the axis of the channel and to the yarn.

U.S. Pat. No. 5,146,660 discloses a device for air-bulking multifilament yarn. This device has a two piece body formed by a nozzle unit and a baffle unit that are attached to form a yarn channel. When yarn is inserted in this yarn channel through a threading slot, air is injected through the nozzle unit to intermingle the multifilament yarn. Thread guides in the form of glued-in sapphire pins are inserted in the nozzle unit at both ends of the yarn channel. These thread guides position the yarn to maintain a minimum distance from the nozzle section.

U.S. Pat. No. 5,010,631 also discloses an air nozzle with a continuous yarn channel with an open treading slot. A baffle wall section opposed to a nozzle wall section is configured so that the air stream deflected by the baffle wall section does not enter the threading slot. The stated purpose for this configuration is to prevent filaments and filament bundles from being carried along with the airstream so that they will not impinge upon the edges of the threading slot and be damaged.

European Patentschrift 0 564 400 B1 discloses a device for intermingling multifilament yarn in which opposite walls of a yarn channel are convexly curved so that the distance between the two wall surfaces gradually increases from a minimum at the outlet of a jet nozzle toward both ends of the yarn channel. Thread guides are positioned at both ends of the yarn channel and both thread guides are at the same elevation so that the yarn cannot follow the curved surface of the yarn channel and the position of the yarn relative to a threading slot remains essentially constant along the axis of the yarn channel.

U.S. Pat. No. 4,430,780 discloses a fluid flow commingling jet having a threading slot that extends substantially tangentially relative to the yarn channel. A fluid flow pin is mounted on a plate having yarn guide located at one end of the yarn channel. The position of the fluid flow pin alters the fluid flow characteristics of the jet to produce a forwarding action. A prior art closed jet with a tapered yarn channel to cause air to flow in the direction in which the thread is moving is also described.

SUMMARY OF THE INVENTION

The representative embodiments of the invention depicted herein comprise interlacing jets for use in commingling fibers to form a yarn. The jets have a body with first and second sides and first and second ends. A yarn channel extends through the body between the first and second ends. An air inlet communicates with the yarn channel. Parallel grooves extend along both the first and second sides between the first and second ends, and a support member with cylindrically protruding members are located in the parallel grooves on opposite sides of the body to secure the body to the support member.

These jets can be used in an assembly of interlacing jets positioned side by side in which each jet interlaces a single textile yarn. In this assembly the mounting grooves on each jet extend parallel to the yarn channel with grooves on adjacent jets being juxtaposed and aligned. A rod extends through aligned grooves parallel to the yarn channel to hold adjacent jets side by side.

Since the air jet is fabricated from a single piece, there is no need for complicated hardware to attach one air jet next to another similar jet. This air jet insert has mounting grooves on two sides, which can be viewed as the front and rear of the jet insert. Two jets can be placed in abutting relationship with opposed mounting grooves in alignment. A male mounting member can then be inserted into the hole formed by the abutting grooves so that the two jets can be secured together. Multiple jets can be positioned in abutting side by side relationship so that the centerlines between adjacent yarns can be closely spaced.

BRIEF DESCRIPTION OF THE DRAWINGS

FIG. 7 is a bottom view of a closed jet of the type shown in FIG. 6 showing a spring loaded support member engaging the closed jet.

FIG. 8 is an end view of the jet shown in FIG. 7.

DETAILED DESCRIPTION OF THE PREFERRED EMBODIMENTS

Figure 1:
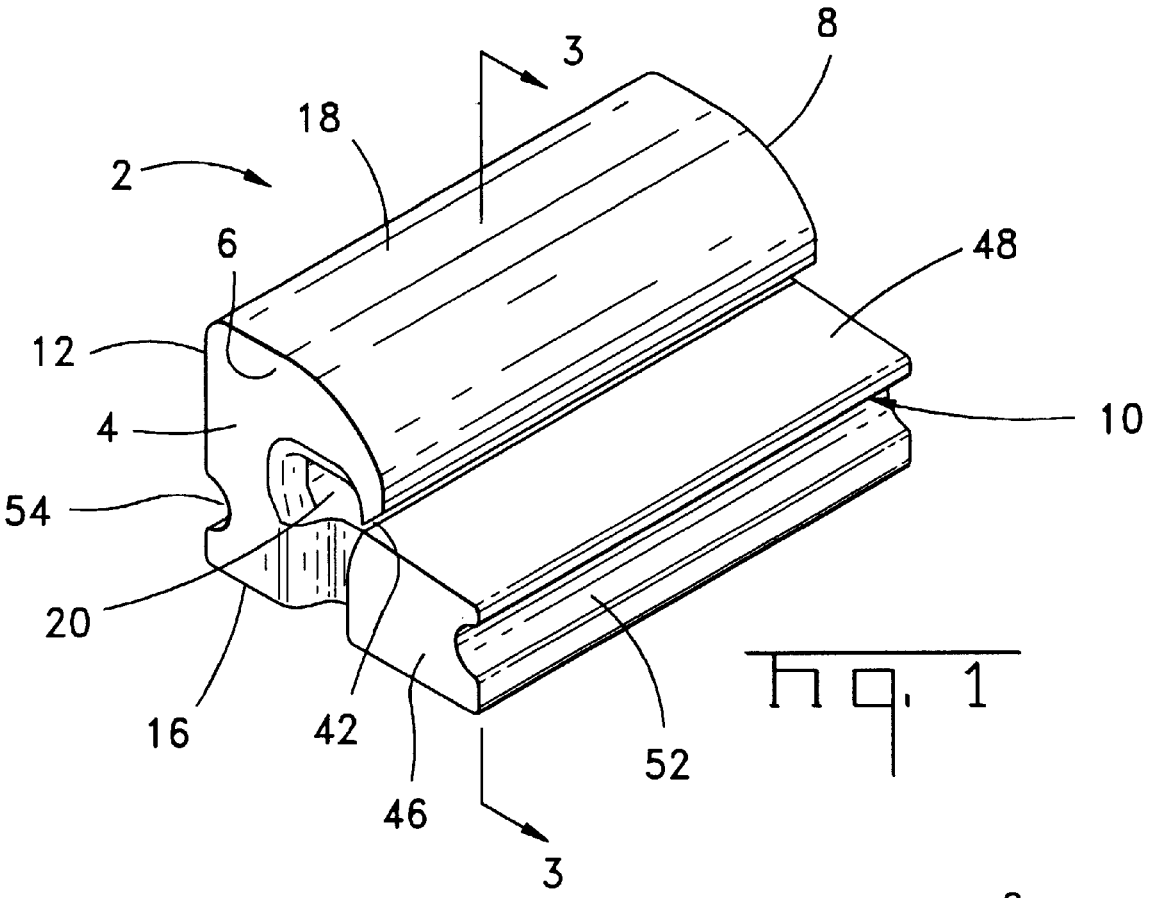
FIG. 1 is a three dimensional view of an interlacing jet showing the threading slot through which yarn can be inserted into a yarn channel

The first of the representative embodiments of the instant invention comprises a one piece jet or jet insert 2 that is used for interlacing, commingling or intermingling multiple filaments to form a yarn of intermingled fibers or filaments. This jet can also be used for air bulking multifilament yarns. The jet 2 has a single piece body 4 with a yarn channel 20 extending between opposite ends and an air inlet or orifice 40 communicating with the yarn channel 20. This jet 2 is an open jet with a threading slot 42 which opens into the front of the yarn channel 20 between the top and the bottom of the channel.

Figure 2:
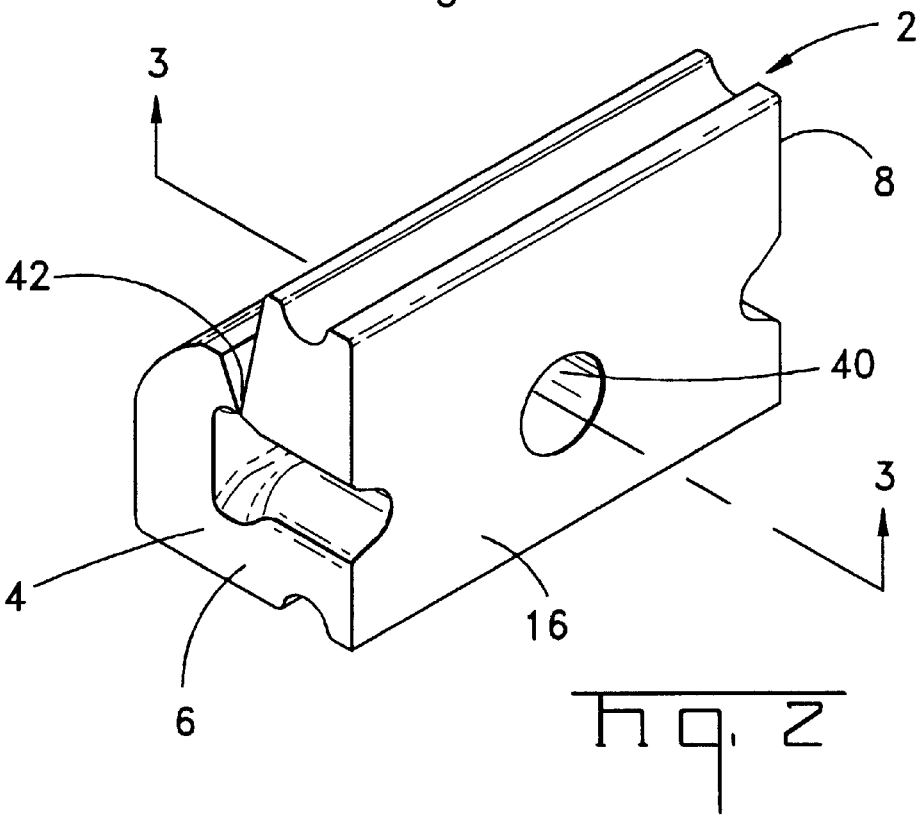
FIG. 2 is a three dimensional view of an interlacing jet showing the bottom surface through which the air inlet orifice extends.

FIGS. 1 and 2 show a single jet 2 from two different perspectives. FIG. 1 shows the jet from above, and the treading slot 42 can be seen to extend from a first end 6 of the body to a second end 8. FIG. 2 shows the jet from below, and the air inlet or orifice 40 is shown extending from the center of the bottom face 16 of the body toward the yarn channel 20. An air feed, not shown, can be connected to the air inlet 40, and high pressure air flows through the air inlet 40 into the channel 20. In the preferred embodiment, this configuration comprises a sonic nozzle.

The axis of the longitudinal yarn channel 20 extends between the first body end 6 and the second body end 8. A first or front side 10 extends between the two body ends and a second or rear side 12 extends not only between the two body ends 6 and 8, but also between the bottom face 16 and the top of the upper curved face 18.

A continuous yarn or multiple yarn filaments can be inserted into the yarn channel 20 through the threading slot 42 which extends parallel to the axis of the yarn channel 20 between both ends of the body 4. The height of the threading slot 42 is sufficient to permit insertion of the yarn or yarn filaments, but the size of this slot 42 should not be too large or there could be a tendency for the yarn to escape from the yarn channel 20. As previously discussed, the lower surfaces of the yarn channel 20 progressively diverge from the threading slot 42 towards the ends of the body 4. This will permit the yarn to extend below the threading slot during operation of the interlacing jet 2 and the tendency of the yarn or yarn filaments to escape through the threading slot 42 will be decreased because the yarn would be held in place at least at the ends of the yarn channel.

Figure 3:
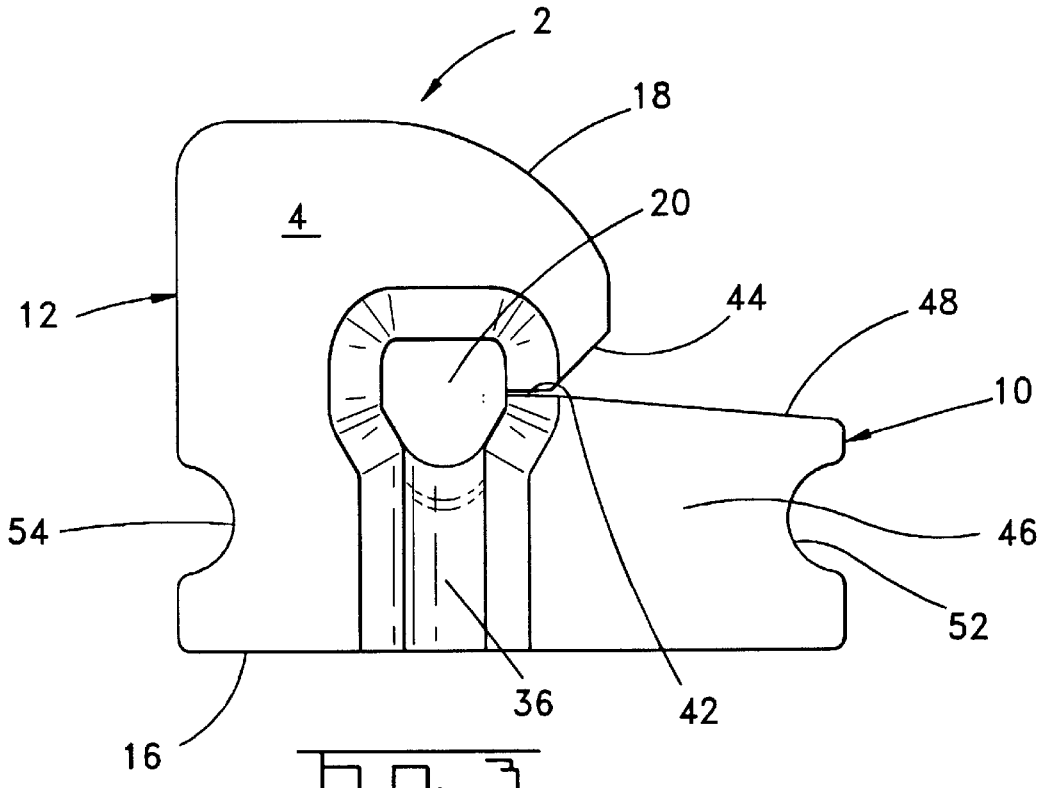
FIG. 3 is an end view of the jet showing one of the filets that intersect the yarn channel at each end.

The edges of the threading slot 42 adjacent the intersection of the threading slot 42 with the yarn channel 20, are parallel and define the minimum height of the threading slot 42. These edges of the threading slot 42 intersect a vertical wall of the yarn channel 20 and are not mutually offset at this point. This narrow section of the threading slot diverges at the outer opening of the threading slot 42 to form a tapered entrance 44, as best seen in FIG. 3, so that the yarn or yarn filaments can be easily inserted into the threading slot 42. The upper portion of this tapered entrance 44 is initially in the form of an inclined flat face which then merges with the curved top surface 18 of the body 4. The lower surface of threading slot 42 is coplanar with an upwardly facing surface 48 on a ledge 46 that extends laterally beyond the top surface of the body 4. This upper ledge surface 48 is inclined relative to the horizontal, and the surfaces forming the tapered entrance 44 subscribe an angle of approximately fifty degrees.

Mounting grooves 52 and 54 are formed on the sides of the body 4. This mounting grooves 52 and 54 are curved and each forms a semicircular surface facing outward. Each groove 52 and 54 is located adjacent to bottom of the body 4 and is equally spaced above the bottom face 16. When mounted side by side in abutting relationship, in the manner to be subsequently discussed, these grooves 52 and 54 will be located in an opposing relationship.

Figure 4:
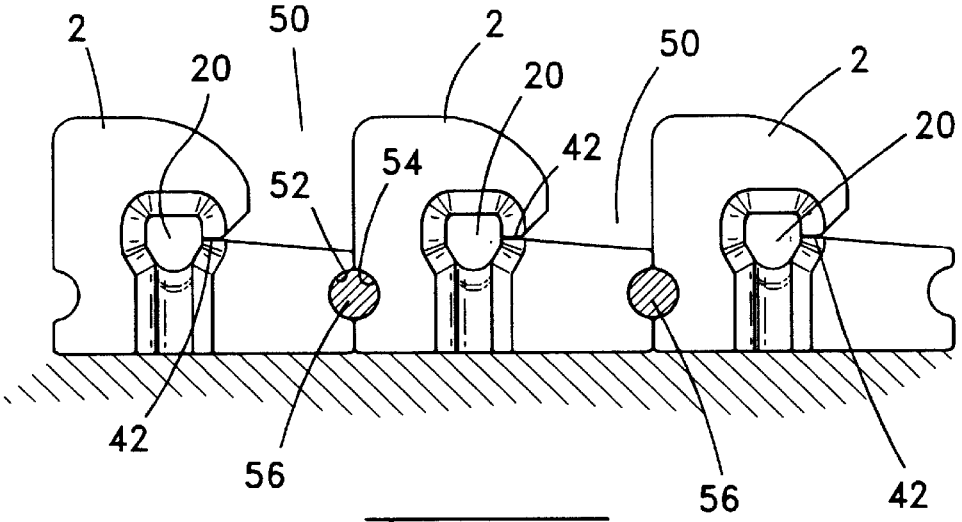
FIG. 4 is a view of the jet with a yarn guide bracket attached to the jet.
Figure 5:
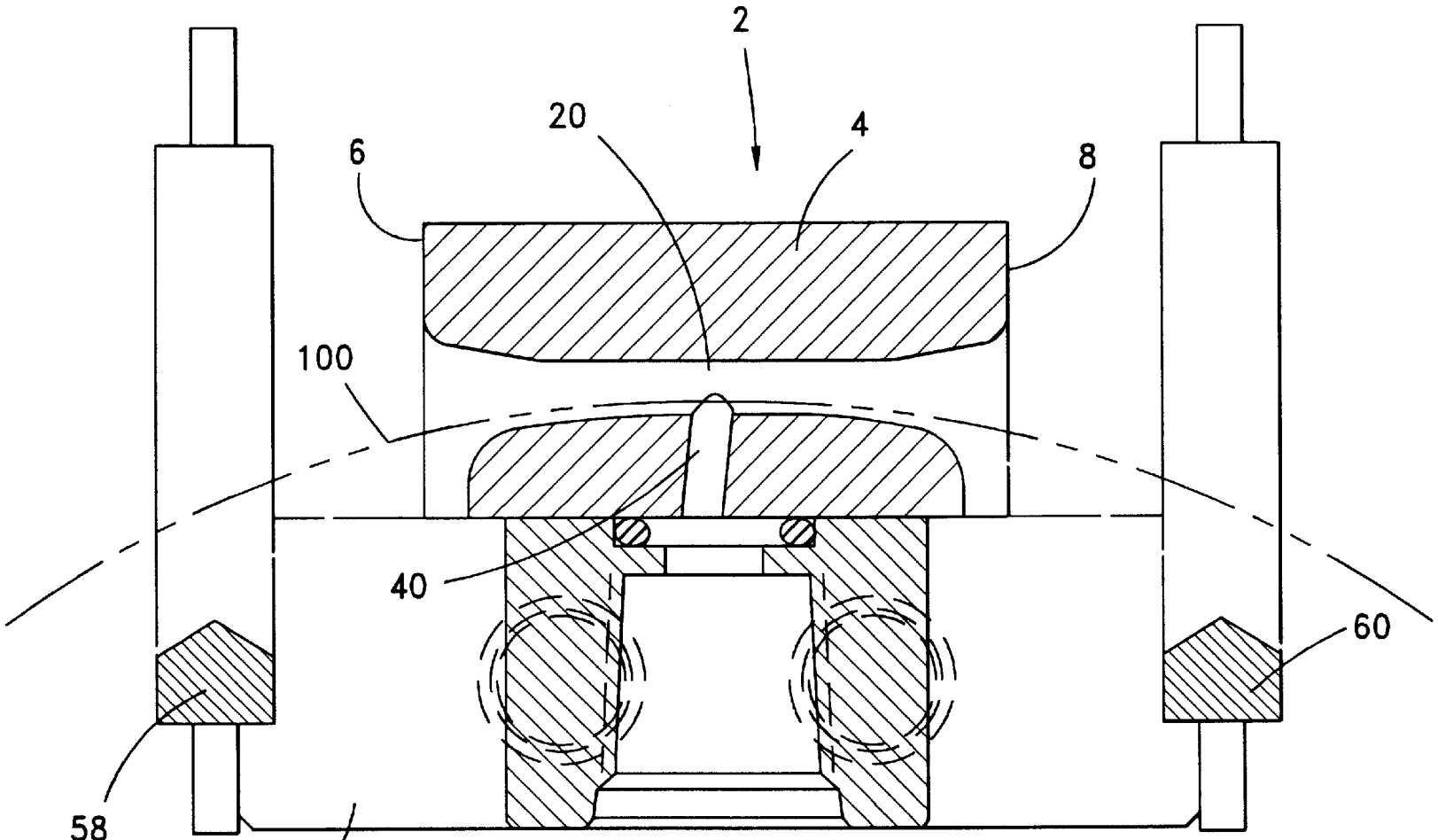
FIG. 5 is a view showing three separate jets attached side to side in close proximity.

External guides 58 and 60 are shown in FIG. 4. These external guides 58 and 60 are spaced from the ends 6 and 8 of the body 4, and the guides are located in a plane extending through the axis of the yarn channel 20. However, each guide 58, 60 is positioned below the axis of the yarn channel 20 and below the threading slot 42. These external guides 58, 60 are positioned so that a line extending generally parallel to the tapered lower surfaces 30, 34 at the ends of the yarn channel 20 will intersect these yarn guides. This line corresponds generally to the path of the yarn 100 passing through the interlacing jet 2. When the yarn extending along the curved path 100 is positioned in the guides 58, 60, the yarn is held under tension and cannot escape from the yarn channel. Since the yarn path 100 must extend at a downward angle relative to the extended axis of the yarn channel 20 and relative to the horizontal plane of the threading slot 42, the yarn cannot escape from the yarn channel 20 through the threading slot 42 The external guides 58 and 60 are held in place by a guide bracket 62 that can be attached to the interlacing jet body 4. As shown in FIG. 5, the bracket 62 is attached to the back of the body 4 with the external guides 58 and 60 then being positioned beside the end faces 6 and 8.

Figure 9:
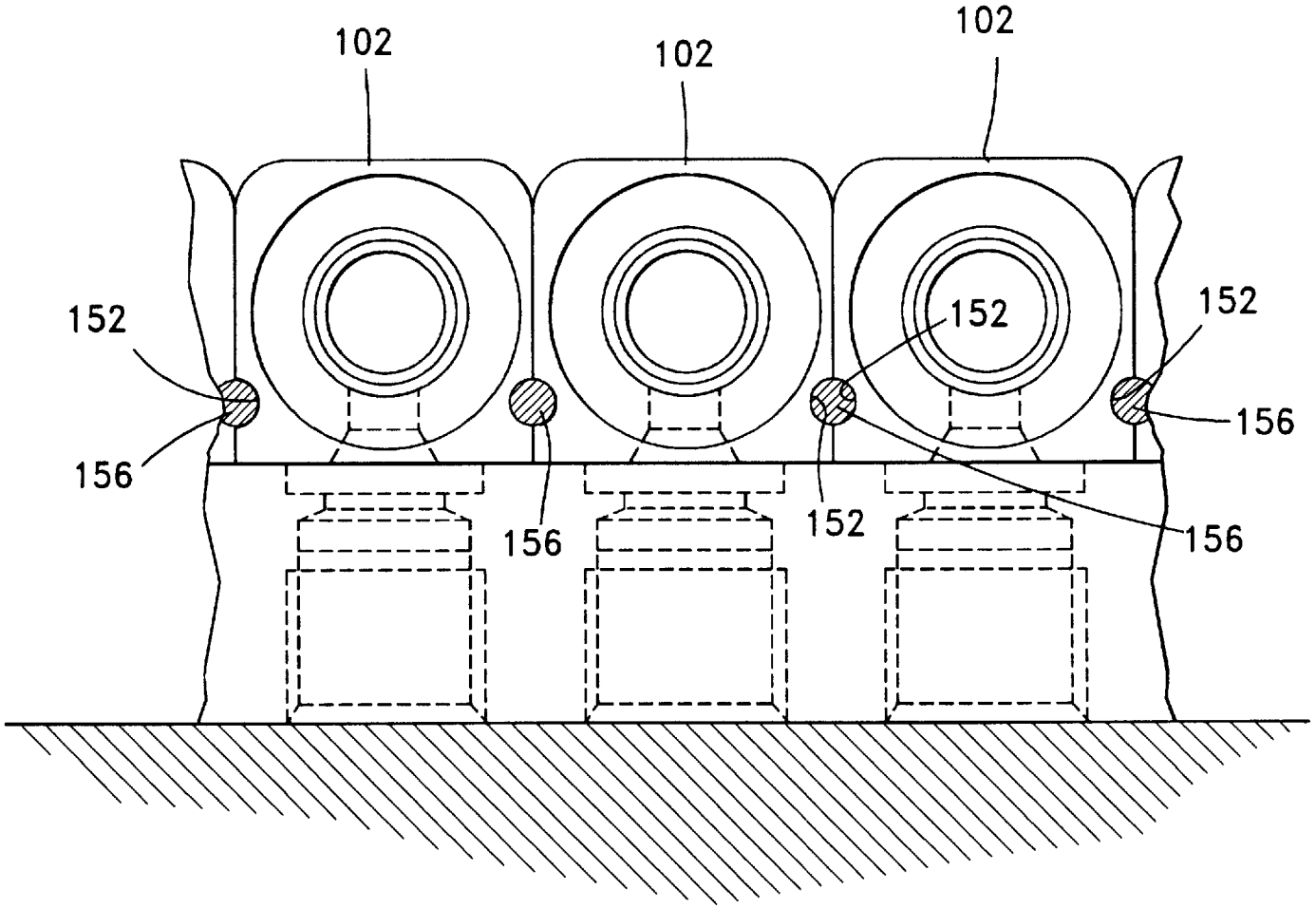
FIG. 9 is a view showing three closed jets of the type shown in FIGS. 6–8 mounted side by side with mounting rods extending between adjacent closed jets.

FIG. 5 shows a single interlacing jet 2 with a guide bracket 62 for a single yarn or for filaments for forming a single interlaced yarn. The interlacing jets 2 can however be positioned side by side in a closely spaced configuration as shown in FIG. 9. When multiple jets 2 are positioned in this manner, the mounting grooves 52 and 54 are aligned and a single mounting pin 56 can be positioned between two jets to secure them in place. Stated differently, adjacent jets 2 can be positioned on either side of mounting pin or rod 56, which extends parallel to the yarn channel, with the mounting grooves 52 and 54 being positioned around the mounting rod 56. In other words, the rod 56 positions the adjacent jets 2. Two jets 2 on either side of a rod 56 are also held in place by the force exerted by an 0-ring that fits between the air fitting and the air inlet of the jet so the mounting grooves 52, 54 are urged against the mounting rod 56. When held in this manner, jets 2 can be positioned so that the centerline between adjacent yarn paths will be on the order of 8 to 12 mm. This relatively close spacing provides an economical use of space. Even though the jets are closely spaced, there is still adequate room for lacing yarns or yarn filaments into through the threading slots 42 into the appropriate yarn channel. As shown in FIG. 4 a gathering area 50 is defined above the ledges 46 of each jet. The curved upper surface 18 of the body 4 provides a good lead in so that the yarn or yarn filaments can be laced downwardly into engagement with upper ledge surface 48 and then laterally through the threading slots 42 into the yarn channel. In order to position the yarn in the air jet yarn channel 20, either the tension on the yarn must be released or sufficient slack must be provided to permit the yarn or yarn filaments to be both threaded through the slot 42 and positioned in guides 58, 60. After the yarn or yarn filaments are in place, tension on the yarn causes it to maintain a inclination at both ends of the yarn channel so that the yarn cannot escape through the yarn channel. As high pressure air is injected through the orifice 40 the filaments forming the yarn are interlaced as the yarn moves through the yarn channel. For textured multifilament yam the tension applied to the yam also tends to prevent the knots formed in the kinky yarn by the jet from loosening as the yarn leaves the jet. The curved and tapered contour of the lower surface of the yarn channel will tend to reduce turbulence, and by keeping the yarn close to this surface, the yarn will in any event be subjected to less turbulent air which might tend to unravel the knots.

A second embodiment of this invention is shown in FIGS. 6–9. This second version comprise a closed jet 102 having a one piece body 104 with a yarn channel 120 extending between opposite ends. In this embodiment, the yarn channel 120 has a circular cross section for most of its length. An air inlet or orifice 140 intersects the yarn channel 120 adjacent the center of the yarn channel, and the ends of the yarn channel have conical tapered surfaces 130 so that yarn can enter or emerge from the yarn channel at an angle without damage to the yarn.

The body 104 has a generally rectangular cross section with generally flat side surfaces and generally flat top and bottom surfaces. The top corners are rounded. Two parallel grooves 152 are located in the two side surfaces adjacent the intersection of the side surfaces and the bottom surfaces. In the preferred embodiment of this version, the two grooves 152 have a semicircular shape and the grooves are equidistantly spaced from the bottom surface of the body 104. Each groove 152 is shaped so that half of a rod 156 having a right circular cross section will fit within the groove. Both the open and closed jet version depicted herein are preferably formed from titanium carbonitride.

Figure 6:
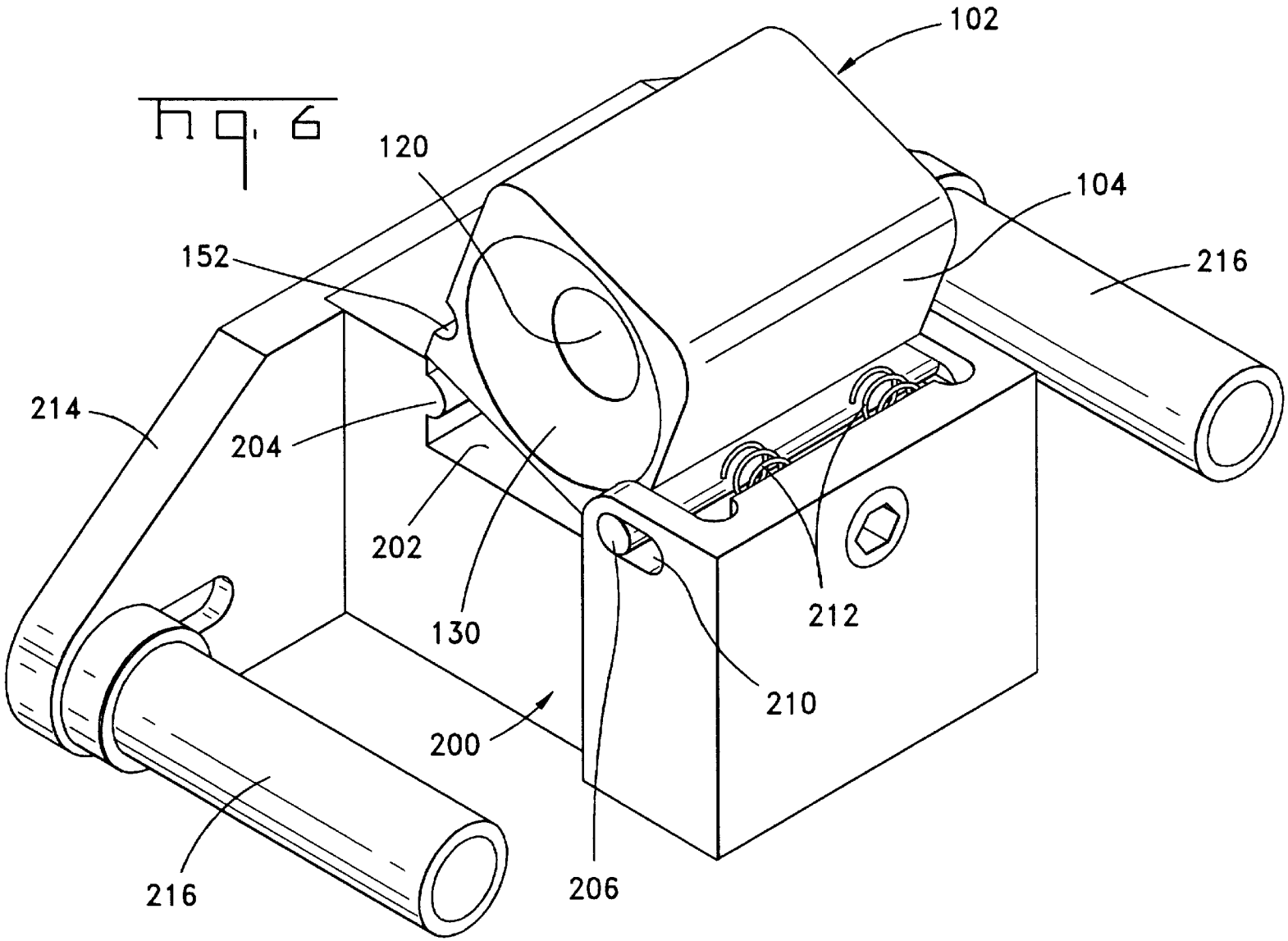
FIG. 6 is a view of a single closed jet and the support in which it can be mounted.

FIG. 6 shows one method of mounting a single closed jet 102 in a base support or mount 200 which has a recess 202 dimensioned to receive the lower portion of the jet body 104. A protruding circular ridge 204 extends from one side of the body into the recess 202 and is located above the bottom of recess 202 by the same distance that a groove 152 is spaced above the bottom of the jet body 104. The circular ridge 204 is dimensioned so that it will fit in an adjacent groove 152 when the closed jet 102 is positioned in the recess 202. A rod 206 is located on the opposite side of the recess 202 in a position so that it will fit into a groove 152 on that side of the jet body 104. The rod 206 is mounted in a block 208 that is attached to the opposite side of the base 200. The ends of the rod 206 are located in oblong slots 210 and two coil springs 212 positioned between the rod 206 and the block 208. This spring loaded rod 206 permits a single closed jet 102 to be mounted in the base or support 200 by rocking the jet into position. The jet 102 is first positioned at an angle as shown in FIG. 6 with the rod 206 positioned in the corresponding groove 152. The jet body 104 is then pushed against the springs 212 so that the jet body is shifted laterally relative to the recess 202. The block 208 provides clearance for the jet body 104 to shift in this manner. Movement of rod 206 provides clearance so that the lower opposite edge of the jet body can shifted past the stationary ridge 204 protruding into the opposite side of recess 202. The jet body 104 can then be rocked into position so that the ridge 204 will fit in adjacent groove 152 permitting the spring loaded rod 206 to return to its normal position so that the closed jet 102 can be secured in the center of the recess 202. Although FIG. 6 only shows a closed jet 102 mounted in this manner, the same approach could be used with an open jet 2.

FIG. 6 also shows a guide bracket 214 secured to the base 200 on the side opposite from block 208. Two cylindrical yarn guides 216 are mounted on the guide bracket 214 so that yarn entering or exiting the jet 102 will be supported in a conventional manner.

FIG. 9 shows multiple closed jets 102 can be mounted side by side in the same manner as for the open jets 2 shown in FIG. 4 so that multiple closed jets 102 can located on closely spaced centerlines. After the jets 102 are positioned in this manner, rods 156 can be inserted into the circular openings formed opposed grooves 152 on adjacent closed jets 102.

Although this preferred version of the closed jets 102 shows the use of semicircular grooves 152 and right circular rods 156, it should be understood that other shapes could be employed. For example the rod could be square and the corresponding grooves could be shaped to receive a square rod. Although the preferred embodiments shows the use of a tapered lower surface of the yarn channel, other aspects of this invention can be used without tapering the lower surface. For example, the yarn guides could be aligned with the axis of the yarn channel, but the jets could still be positioned side by side in the manner shown herein. Furthermore the mounting means used with the preferred embodiments of this invention could be used with a two piece body in addition to its use with a single piece body. One of ordinary skill in the art would also realize that in addition to using the rods and grooves used in the preferred embodiment, interfitting tongues and grooves that are part of the jet body and which extend in the same direction could also be used. Therefore the preferred embodiment shown herein is merely representative, and the invention is defined by the claims presented herein.

I claim:

1. An interlacing jet for use in commingling fibers to form a yarn, the jet comprising:

a body having first and second sides and first and second ends;

a yarn channel extending through the body between the first and second ends;

an air inlet communicating with the yarn channel;

parallel grooves extending along both the first and second sides between the first and second ends, and a support member with cylindrically protruding members extending in the parallel grooves on opposite sides of the body to secure the body to the support member.

2. The interlacing jet of claim 1 wherein one of the cylindrically protruding members is spring loaded relative to the support member so that the body can be rotated into position when mounted on the support member.

3. The interlacing jet of claim 1 wherein the jet comprises a closed jet in which the yarn channel comprises a closed cylindrical channel extending between the first and second ends.

4. The interlacing jet of claim 1 wherein the cylindrical protruding members comprise rods.

5. The interlacing jet of claim 4 wherein rods on both sides of the body comprise separate members insertable into the parallel grooves and axially movable relative to the support member.

6. The interlacing jet of claim 4 wherein the rods are insertable into aligned, juxtaposed grooves in side by side jets.

7. An assembly of interlacing jets positioned side by side in which each jet interlaces a single textile yarn:

each jet comprising a body with first and second opposite sides extending between first and second ends;

each jet includes a yarn channel extending between first hand second opposite ends of the body;

each jet also including mounting grooves on the first and second sides of the body, the mounting grooves extending parallel to the yarn channel with grooves on adjacent jets being juxtaposed and aligned; and a rod extending through aligned grooves parallel to the yarn channel to hold adjacent jets side by side.

8. The assembly of claim 7 wherein the jets are each closed jets.

9. The assembly of claim 8 wherein the first and second sides of the closed jets comprise flat side surfaces through which the grooves extend, flat side surfaces of adjacent jets being positioned side by side.

10. The assembly of claim 9 wherein adjacent jets are spaced apart by a distance less than an exterior dimension of the rod.

11. The assembly of claim 10 wherein flat side surfaces of adjacent jets are positioned in contact with each other.

12. The assembly of claim 11 wherein the rods are right circular cylinders.

* * * * *